US005312497A

United States Patent [19]

Mathey

[11] Patent Number: 5,312,497

[45] Date of Patent: May 17, 1994

[54] METHOD OF MAKING SUPERALLOY TURBINE DISKS HAVING GRADED COARSE AND FINE GRAINS

[75] Inventor: Gerald F. Mathey, Jupiter, Fla.

[73] Assignee: United Technologies Corporation, Hartford, Conn.

[21] Appl. No.: 816,370

[22] Filed: Dec. 31, 1991

[51] Int. Cl.[5] ..... C22C 19/00

[52] U.S. Cl. ..... 148/675; 148/410; 148/676; 148/902

[58] Field of Search ..... 148/410, 675, 676, 902

[56] References Cited

U.S. PATENT DOCUMENTS

| | | | |
|---|---|---|---|
| 4,680,160 | 7/1987 | Helmink | 419/6 |
| 4,685,977 | 8/1987 | Chang | 148/12.7 |
| 4,728,374 | 3/1988 | Larson et al. | 148/902 |
| 4,816,084 | 3/1989 | Chang | 148/13 |
| 4,820,356 | 4/1989 | Blackburn | 148/12.7 |
| 4,820,358 | 4/1989 | Chang | 148/13 |
| 4,888,064 | 12/1989 | Chang | 148/67 |
| 4,907,947 | 3/1990 | Hoppin, III | 148/514 |
| 5,100,484 | 3/1992 | Wukusick et al. | 148/675 |
| 5,143,563 | 9/1992 | Krueger et al. | 148/675 |

*Primary Examiner*—Upendra Roy
*Attorney, Agent, or Firm*—Charles E. Sohl

[57] ABSTRACT

A method and apparatus for heat-treating nickel base superalloy articles to provide different properties in different regions of the article. An initially fine grain microstructure is heated such that a portion of the article is held above the $\gamma'$ solvus temperature long enough to provide a coarse grain microstructure while the remainder of the article remains below the $\gamma'$ solvus temperature and retains the fine grain microstructure. The coarse grain microstructure provides a reduced rate of fatigue crack growth rate while the fine grain microstructure retains good tensile properties. The invention is particularly applicable to the fabrication of turbine disks for gas turbine engines.

8 Claims, 3 Drawing Sheets

METHOD OF MAKING SUPERALLOY TURBINE DISKS HAVING GRADED COARSE AND FINE GRAINS

DESCRIPTION

1. Cross Reference to Related Applications

This application is related to the subject matter disclosed and claimed in U.S. Ser. No. 733,446 (currently the subject of a U.S. Patent and Trademark Office secrecy order) entitled Superalloy Heat Treatment for Promoting Crack Growth Resistance by Tillman et al filed on May 10, 1985, which is a Continuation-in-Part of U.S. Ser. No. 434,654 entitled Superalloy Heat Treatment for Promoting Crack Growth Resistance by Tillman et al filed on Oct. 15, 1982 and assigned to the same assignee, herein incorporated by reference.

2. Technical Field

This invention relates to the heat treatment of superalloys and, more particularly, to a heat treatment process which provides different microstructures and mechanical properties in different regions of the heat treated article.

3. Background Art

The operation of gas turbine engines creates an environment in which many of the components are exposed to high temperatures and high stresses. Compression of the gases flowing through the engine and combustion of the fuel expose the rotating components in the turbine section of the engine to temperatures as high as 2700° F. The turbine disks, upon the periphery of which are mounted a plurality of airfoil-shaped blades, rotate at speeds on the order of 8,000 to 10,000 rpm and in so doing generate extremely high stresses at both the rim and the bore of the disk.

It is a characteristic of the operation of these disks that the rim portion is exposed to an operating temperature on the order of 1300° F. while the bore portion operates at temperatures on the order of 1000° F. or lower. In addition, the design of the disks requires high yield strength in the cooler region near the bore and low fatigue crack growth rate in the hotter region near the rim.

Conventional heat treat techniques process the entire disk as a unitary component and provide approximately equivalent mechanical properties in all regions of the disk. However, the design of a disk using this monolithic material must consider the different mechanical property requirements in the different regions of the disk. Since it is virtually impossible to achieve different property requirements in the different regions of a monolithic disk, the resulting design must be a compromise to assure satisfactory performance in all portions of the disk. A compromise generally requires increased section thicknesses to achieve the desired performance in various portions of the disk. Since it is desired to reduce the weight of the engine to achieve the best performance, it is obvious that a compromise of this nature is highly undesirable.

To avoid the design and operational penalties associated with a compromise as described above, it is desirable to produce disks which have different properties in different regions. Miller et al in U.S. Pat. No. 4,608,094 describe a process which includes separate hot working and warm working operations to provide coarse grained, creep resistant material in the region of the rim and fine grained, high yield strength material near the bore of the disk. Walker, in U.S. Pat. No. 4,529,452, diffusion bonds different materials together to form a component, such as a turbine disk, with different properties at the rim and at the bore of the disk.

Tillman et al in U.S. patent application Ser. No. 733,446 (currently the subject of a U.S. Patent and Trademark Office secrecy order), incorporated herein by reference, teach that a supersolvus solution treatment step, i.e., a solution treatment step performed above the temperature at which the $\gamma'$ phase is completely dissolved in the matrix, followed by a subsolvus solution treatment step, followed by at least one aging step provides nickel base superalloy articles with a coarse grain structure and crack growth rates which are greatly reduced relative to prior art heat treatments on the same material.

Chang, in U.S. Pat. No. 4,816,084, teaches the difference in properties available in nickel base superalloys when heat treated using a supersolvus anneal rather than a subsolvus anneal. Chang found that the supersolvus anneal resulted in a coarse grain structure which was resistant to fatigue crack propagation and found further that a very slow cooling rate from the supersolvus annealing temperature also reduced the crack growth rate.

A turbine disk which incorporates the reduced crack growth rate characteristics produced by the supersolvus anneal-based heat treat procedure in the rim portion and the higher yield strength properties achieved by the conventional subsolvus anneal-based heat treat procedure in the hub portion would obviate the need for the compromise required in a monolithic disk. Chang, in U.S. Pat. No. 4,820,358, provides a process directed at providing such a disk. Chang specifies that the cooling rate from the supersolvus anneal temperature shall be at least twice as rapid in the bore portion of the disk as the cooling rate in the rim portion of the disk; I have found that cooling the rim at a faster rate than the bore provides the optimum combination of strength and fatigue crack growth rate resistance.

DISCLOSURE OF THE INVENTION

Accordingly, one object of the invention is to provide a nickel base superalloy turbine disk with different mechanical properties in the rim portion and the bore portion of the disk. Another object of the invention is to provide a means of heat treating a nickel base superalloy turbine disk to achieve a coarse grain structure in the rim portion of the disk and a fine grain structure in the bore portion of the disk, with a cooling rate in the region of the $\gamma'$ solvus temperature which is faster in the rim portion than the cooling rate in the bore portion of the disk.

The invention includes the apparatus and procedures necessary to heat the rim portion of the disk above the $\gamma'$ solvus temperature of the material from which the disk is formed while maintaining the bore portion of the disk below the $\gamma'$ solvus temperature, and to cool the rim portion of the disk through the $\gamma'$ solvus temperature at a minimum rate of about 200° F./minute.

The invention was conceived and developed with respect to turbine disks formed from nickel base superalloys, such as IN 100, Astroloy or René 95. The compositions of these superalloys are listed in Table I.

Other features and advantages will be apparent from the specification and claims and from the accompanying drawings which illustrate an embodiment of the invention.

BEST MODE FOR CARRYING OUT THE INVENTION

The fabrication of a dual property nickel-base superalloy turbine disk requires an apparatus capable of heating the rim portion to a higher temperature than the bore portion, and an additional capability of cooling the rim portion at a fairly high cooling rate while the bore portion cools at a slower rate.

Figure 1:
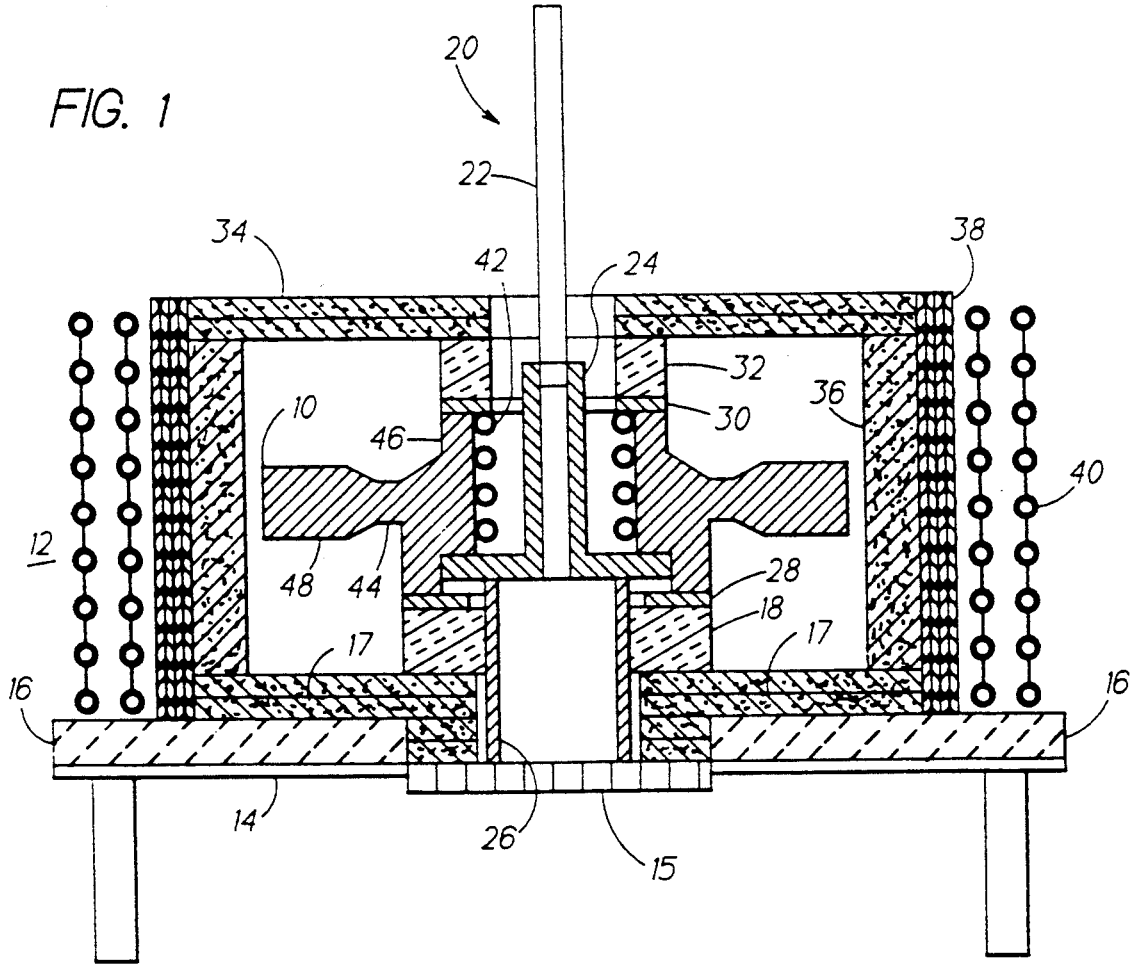
FIG. 1 is a cross section of the apparatus used to solution anneal and cool a turbine disk in the configuration used for solution annealing the disk.

Referring to FIG. 1, a disk blank 10 is placed in the heat treatment apparatus 12. The disk blank is an oversize piece of material in the general configuration of a turbine disk, which has been machined to a configuration suitable for ultrasonic inspection. The disk blank is machined to the final disk configuration after all heat treatment operations are completed. The heat treatment apparatus 12 has a base 14 with an open grate 15 in its center. A layer of insulating brick 16 is placed on the base. Rigid graphite board 17 rests on the insulating brick. A ring of fiberfax insulation 18 rests on the rigid graphite board.

A puller assembly 20, which includes a lifting rod 22, a disk support 24, and a support ring 26, serves to load the disk blank and relocate it for cooling, as described below. Copper shunts 28, 30 are clamped to the disk blank prior to loading to direct the induced electrical field during heating.

A fiberfax ring 32 is placed on top of the upper copper shunt 30, and additional layers of rigid graphite board 34 are placed on the fiberfax ring. A graphite susceptor 36 surrounds the disk blank 10 and rests on the rigid graphite board 17. Several layers of graphite felt 38 are wrapped around the susceptor 36. A water cooled induction coil 40 surrounds the entire heat treating apparatus. A cooling coil 42 is positioned inside the bore of the disk blank 10.

To perform a solution annealing operation on the disk blank, the entire heat treat apparatus 12 is placed in a vacuum chamber (not shown) and an alternating current is passed through the induction coil 40. Alternating current is supplied to the induction coil to obtain a predetermined temperature as measured by a thermocouple attached to the surface of the web 44 of the disk blank lo at the location at which the transition from a coarse grain to a fine grain microstructure is desired. The graphite susceptor 36 is heated to a temperature at which it radiates energy to the disk blank 10. The susceptor also reduces the strength of the induction field in the bore 46 of the disk, generally restricting the induction heating action to the rim 48 of the disk. The insulating materials below and above the disk blank restrict the radiation of heat away from the disk and minimize temperature fluctuations in the disk blank during the heat treating operation. The cooling coil 42, which typically uses 18–20 psi shop air, removes heat from the bore 46 of the disk to assure a sufficient temperature gradient within the disk during the heat treatment. It does not serve to influence or control the cooling rate during the quenching part of the operation.

The predetermined set temperature in the web 44 is equal to the $\gamma'$ solvus temperature for the disk material. The apparatus is designed such that the rim 48 of the disk is heated to a temperature above the set temperature, but below the incipient melting temperature of the material. When the rim 48 has been above the $\gamma'$ solvus temperature for sufficient time to dissolve all of the $\gamma'$ and allow sufficient grain growth in the rim portion, generally one to four hours, but preferably two to three hours, the power to the induction coils is turned off and the disk blank is ready to be cooled.

Figure 2:
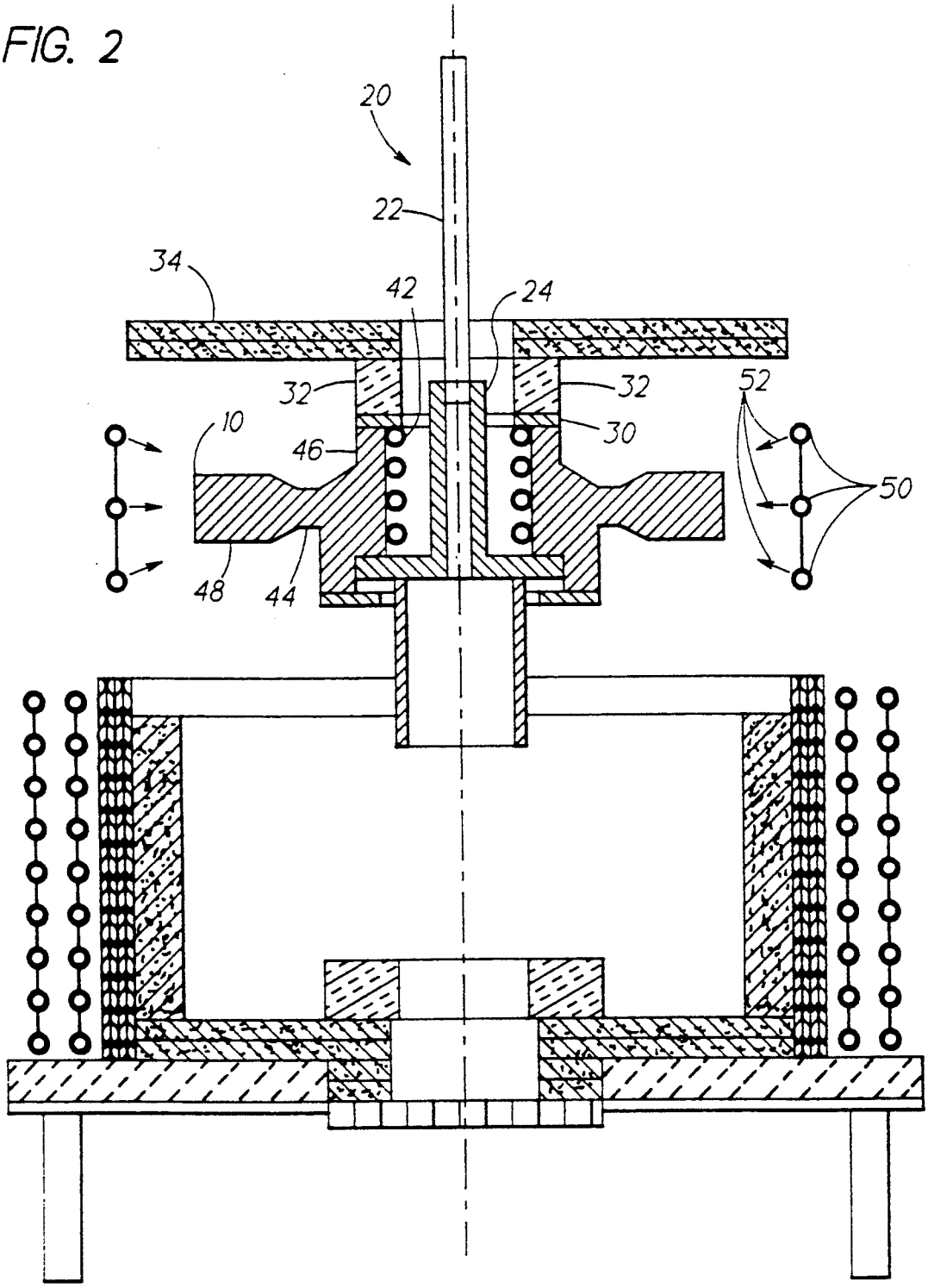
FIG. 2 is a cross section of the apparatus of FIG. 1 in the configuration used for cooling the disk.

As shown in FIG. 2, a lifting actuator (not shown) is activated to raise the puller assembly 20 which, in turn, raises the disk blank 10, the ring 32, the rigid graphite board 34 and the cooling coil 42 up to a position between a set of three cooling rings 50. The cooling rings have orifices to direct the flow of a cooling fluid, typically helium gas, onto the rim 48 as indicated by the arrows 52. The cooling gas is supplied at a rate which cools the rim 48 at a minimum of 200° F./minute through the $\gamma'$ solvus temperature. This cooling rate during the time period when $\gamma'$ is precipitating from solid solution was determined by Tillman et al to be critical in controlling the grain boundary $\gamma'$ morphology. This cooling method assures a minimum cooling rate of approximately 150° F./minute in the hub 22.

It will be obvious to one skilled in the art that various modifications in component design or even the choice to use certain features of the apparatus, e.g., copper shunts or a susceptor, may be made without departing from the spirit and scope of the invention.

Subsequent processing operations typically include a subsolvus annealing operation between 30 and 200° F. below the $\gamma'$ solvus temperature for one to ten hours, followed by aging at one or more temperatures between about 800° F. and 1800° F. for a total time of about three to 50 hours.

The process of the present invention may be better understood through reference to the following illustrative examples.

Example I

The invention will be described with regard to the fabrication of a turbine disk from a nickel base superalloy known as IN 100. This alloy is widely available and commonly used in the high temperature portions of a gas turbine engine. The nominal composition of this alloy, in percent by weight, is 12.4 Cr, 18.5 Co, 4.3 Ti, 5.0 Al, 3.2 Mo, 0.07 C, 0.08 V, 0.06 Zr, 0.02 B, balance Ni.

The IN 100 material is commonly available as a casting which is forged, or as powdered metal which is consolidated under conditions of elevated temperature and pressure. In this example, consolidated powder metal was isothermally forged into a disk blank at about 1975° F. to 2000° F. at a strain rate of about 0.1 to 0.5 in/in/minute. The process employed is described in U.S. Pat. No. 3,519,503, to Moore et al, the contents of which are incorporated herein by reference. The resultant material had a uniform fine grain size of approximately ASTM 11–12.

After machining to a sonic inspection shape, the disk blank was loaded in the heat treat apparatus previously described and the apparatus was placed in the vacuum chamber, which was evacuated to a level of 100$\mu$ or less to minimize convective heat transfer within the vacuum chamber. Two hundred fifty kilowatts of power at 60 cycles per second were applied to the induction coils which heated the disk blank up to the predetermined set temperature of 2140° F. in the web, resulting in a temperature in the rim of the disk blank of approximately 2190° F. The $\gamma'$ solvus temperature for this particular material had been previously established as 2140° F. The disk blank was held at this temperature for two hours to dissolve the $\gamma'$ and allow grain growth in the rim portion of the disk.

The disk blank was then raised to a position midway between the spray rings, and cooled by directing helium at approximately 120 psi through the cooling rings onto the rim of the disk blank. This resulted in a cooling rate of 300–350° F./minute in the rim portion of the disk blank, which is approximately the same as experienced with a conventional fan air cool of a similar part, and approximately 150° F./min in the bore portion of the disk blank. After cooling at this rate to about 1665° F., the disk blank was furnace cooled at a rate greater than 100° F./min to below 500° F.

The disk blank was subsolvus annealed at 2065° F. for two hours and fan air cooled, then aged at 1200° F. for 24 hours and 1400° F. for four hours.

Figure 3:
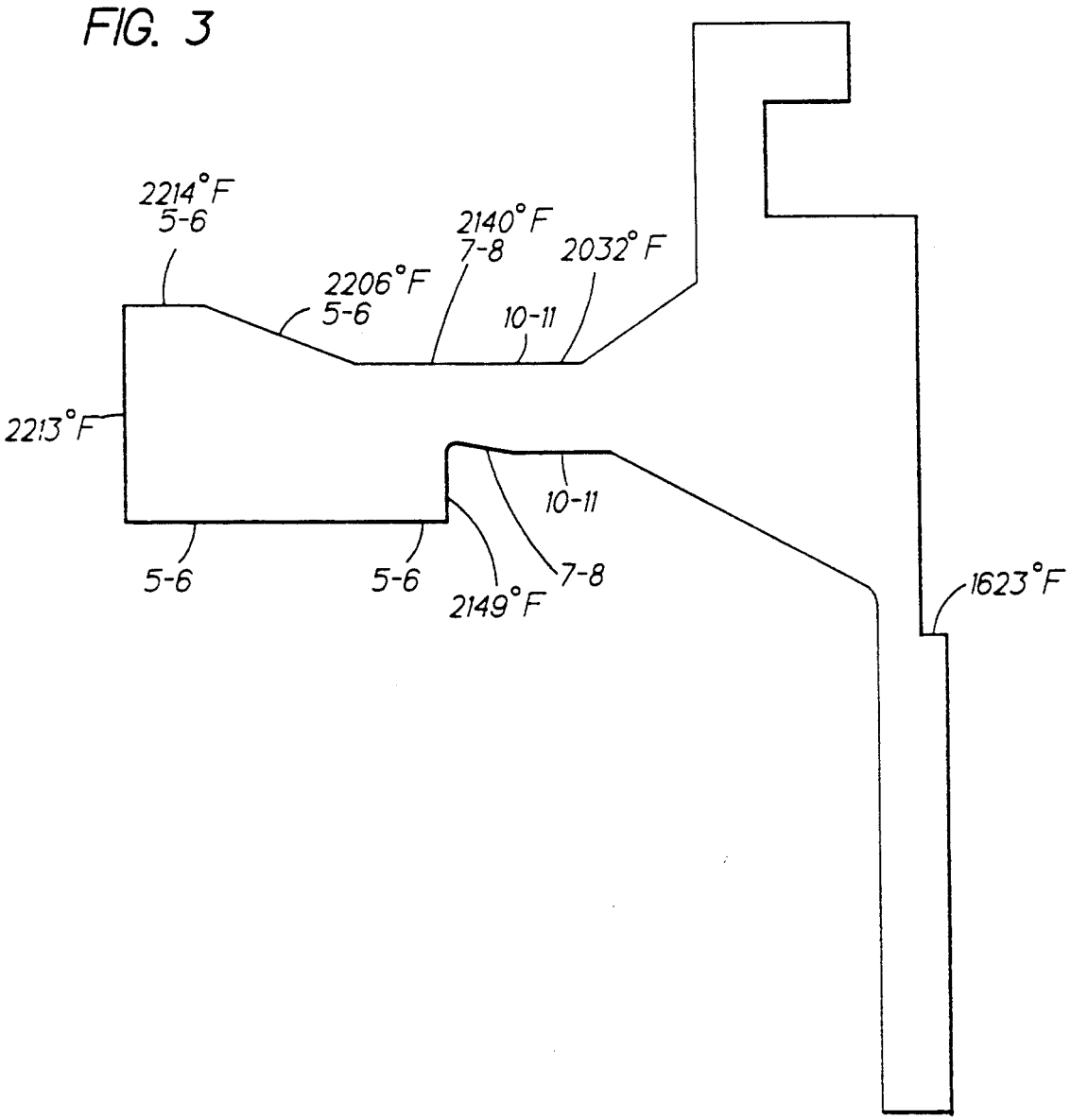
FIG. 3 is a cross sectional view of a turbine disk showing the temperatures during solution anneal and the resulting grain sizes.

FIG. 3 shows a cross-section of the disk blank with the temperatures as measured at various locations during the supersolvus heat treatment, and the resultant grain sizes as measured metallographically. A grain size of ASTM 5–6 was achieved in the rim portion of the disk, while the grain size in the bore portion of the disk remained virtually unchanged. Mechanical property evaluation showed that the tensile strength in the hub portion of the disk blank was the same as in a conventionally subsolvus annealed disk, while the fatigue crack growth resistance was improved by a factor of greater than 4× in the rim portion of the disk.

Example II

A disk blank similar to that used in Example I was subsolvus annealed at approximately 2065° F. for two hours and oil quenched to precipitate and coarsen the $\gamma'$. This effectively established the ultimate microstructure in the bore portion of the disk.

The disk blank was then heated in the heat treat apparatus of the invention. The disk was heated such that the temperature in the web was 2140° F., thus achieving a temperature gradient similar to that in Example I. After holding for two hours to allow recrystallization and grain growth, the disk blank was cooled such that the rim portion cooled at approximately 200° F./hour to approximately 2065° F., where it was held for thirty minutes. The disk blank was then cooled at 300–325° F./min to approximately 1200° F. and furnace cooled to room temperature.

The disk blank was stress relieved at approximately 1800° F. for about one hour, followed by a double fan air cool to room temperature, and precipitation heat treatment at approximately 1350° F. for about eight hours, followed by air cooling to room temperature.

This heat treatment resulted in the disk blank having essentially the same mechanical properties as those produced in Example I.

The capability of performing the process of this invention to maximize the crack growth resistance in the rim and retain good tensile strength in the hub has resulted in a reduction of 33 pounds of weight in the high pressure turbine disk and ten pounds in the low pressure turbine disk of a particular gas turbine engine compared to the compromised design of a monolithic disk produced by either the subsolvus or supersolvus heat treatment being performed on the entire disk.

It should be understood that the invention is not limited to the particular embodiments shown and described herein, but that various changes and

TABLE I

TYPICAL SUPERALLOY CHEMICAL COMPOSITIONS*

| | IN-100 | ASTROLOY | RENE 95 | BROAD RANGE |
|---|---|---|---|---|
| Ni | Bal | Bal | Bal | Bal |
| Cr | 12.4 | 14.0 | 14.0 | 12–15.5 |
| Co | 18.5 | 17.0 | 8 | 8–19 |
| Ti | 4.3 | 3.5 | 2.5 | 2–4.5 |
| Al | 5.0 | 4.0 | 3.5 | 3.2–5.2 |
| Mo | 3.2 | 5.0 | 3.5 | 2.8–5.4 |
| C | 0.07 | 0.06 | 0.15 | 0.010–0.10 |
| V | 0.8 | — | — | 0–1 |
| Zr | 0.06 | — | 0.05 | 0–0.08 |
| B | 0.02 | 0.03 | 0.01 | 0.005–0.024 |
| Ta | — | — | 3.5 | 0–4 |
| Cb | — | — | — | 0–1.5 |
| Hf | — | — | — | 0–0.45 |
| W | — | — | 3.5 | 0–4 |

*weight percent

We claim:

1. A method for heat treating a nickel-base superalloy turbine disk having a central bore position and a rim portion to provide a fine grain structure in said bore portion and a coarse grain structure in said rim portion, comprising:

providing said disk having an initially uniform fine grain size;

heating said rim portion above the $\gamma'$ solvus temperature for said nickel-base superalloy and cooling to assure that said bore portion is below said $\gamma'$ solvus temperature, and holding for a time sufficient to provide said coarse grain structure in said rim portion;

cooling said disk at a controlled rate to a temperature below said $\gamma'$ solvus temperature, which said controlled rate is greater in said rim portion than in said bore portion;

subsolvus annealing said disk;

aging said disk, thus providing a disk with good tensile strength in said bore portion and good crack growth resistance in said rim portion.

2. A method as recited in claim 1, wherein said superalloy turbine disk has a composition comprising by weight 12–15.5% Cr, 8–19% Co, 2.8–5.4% Mo, 3.2–5.2% Al, 2–4.5% Ti, 0.01–0.1% C, 0.005–0.024%B, 0–0.08% Zr, 0–1% V, 0–0.45% Hf, 0–4% Ta, 0–1.5% Cb, 0–4 W %, balance essentially Ni.

3. A method as recited in claim 1, wherein said superalloy turbine disk is a powder metallurgy product.

4. A method as recited in claim 1, wherein said controlled cooling rate is a minimum of about 200° F./minute.

5. A method as recited in claim 1, wherein said rim portion of said disk is held above said $\gamma'$ solvus temperature for about one to four hours to provide said uniform coarse grain structure in said rim portion.

6. A method as recited in claim 1, wherein said subsolvus annealing is at a temperature of about 30° F. to about 200° F. below said $\gamma'$ solvus temperature for about 1 to 10 hours.

7. A method as recited in claim 1, wherein said aging is at one or more temperatures between about 800° F. and about 1800° F. for a total time of about 3 to 50 hours.

8. A method as recited in claim 1, wherein said turbine disk is heat treated in a vacuum furnace evacuated to a level of 100μ or less.

* * * * *